US006725789B1

(12) United States Patent
Hall

(10) Patent No.: US 6,725,789 B1
(45) Date of Patent: Apr. 27, 2004

(54) PULLER ROLLER SYSTEM FOR TUFTING MACHINES

(75) Inventor: Wilton Hall, Ft. Oglethorpe, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 10/122,535

(22) Filed: Apr. 15, 2002

(51) Int. Cl.[7] ..... D05C 15/18
(52) U.S. Cl. ..... 112/80.73
(58) Field of Search ..... 112/80.01, 80.3, 112/80.7, 80.73

(56) References Cited

U.S. PATENT DOCUMENTS

| | | | | |
|---|---|---|---|---|
| 2,223,914 A | * | 12/1940 | Karns | |
| 2,966,866 A | | 1/1961 | Card | 112/79 |
| 3,095,840 A | | 7/1963 | Ballard | 112/79 |
| 3,224,395 A | * | 12/1965 | Card | |
| 3,847,098 A | | 11/1974 | Hammel, Jr. | 112/79 |
| 4,366,761 A | | 1/1983 | Card | 112/79 |
| 4,608,935 A | | 9/1986 | Bardsley | 112/79 |
| 4,688,497 A | | 8/1987 | Card et al. | 112/80.73 |
| 4,864,946 A | | 9/1989 | Watkins | 112/80.73 |
| 4,870,915 A | | 10/1989 | Bagnall | 112/80.41 |
| 4,981,091 A | | 1/1991 | Taylor et al. | 112/80.32 |
| 5,182,997 A | | 2/1993 | Bardsley | 112/80.73 |
| 5,575,228 A | | 11/1996 | Padgett, III et al. | 112/80.41 |
| 6,202,580 B1 | * | 3/2001 | Samilo | |
| 6,401,639 B1 | * | 6/2002 | Samilo | |
| 6,446,566 B1 | * | 9/2002 | Bennett et al. | |

FOREIGN PATENT DOCUMENTS

| | | | |
|---|---|---|---|
| GB | 2 002 828 | 7/1978 | D05C/15/32 |
| GB | 2 186 297 | 1/1987 | D05C/15/18 |

OTHER PUBLICATIONS

Max M. Beasley, "Mechanical Development in Tufting Machinery," *The American Society of Engineers*, Presentation at the Textile Engineering Conference, Apr. 19–20, 1966.

* cited by examiner

*Primary Examiner*—Ismael Izaguirre
(74) *Attorney, Agent, or Firm*—Womble Carlyle Sandridge & Rice, PLLC

(57) ABSTRACT

A puller roller system for tufting machines having a series of intermeshed puller rolls for tensioning a series of yarns to one or more needles of the tufting machine. According to one embodiment of the invention, the puller roller system includes at least one toothed, driven puller roll in rotating and intermeshing relationship with at least two toothed, floating puller rolls. The spacing between the puller rolls is sufficient to securely engage and tension the yarns to the needles without pinching the yarn.

13 Claims, 3 Drawing Sheets

PULLER ROLLER SYSTEM FOR TUFTING MACHINES

FIELD OF THE INVENTION

The present invention generally relates to machinery and systems for tufting carpets. In particular, the present invention relates to an improved puller roll assembly for a tufting machine.

BACKGROUND OF THE INVENTION

In addition to yarn feed systems and/or pattern yarn feed attachments, tufting machines generally include pairs of toothed puller rolls that tension yarns from the yarn feed mechanism or attachments to needles of the tufting machines. Such puller roll systems typically consist of a drive roll and an idler roll that operate in a rotating, intermeshing relationship. As the rolls rotate, the yarns are engaged and pinched between the teeth of the puller rolls, which engage in an intermeshing fashion, defining a yarn pinch area between the rolls. The yarns are engaged and pinched between the teeth of the puller rolls as they pass through the pinch area, such that the rotation of the rolls causes the yarns to be tensioned between the rolls for feeding to the needles.

With such traditional puller roll systems as described above, there generally is only a limited area or point of contact at which the yarns are pinched and pulled between the puller rolls. As a result of such limited contact of the yarns with the rolls, the yarns therefore must be tightly engaged or pinched between the teeth of the rolls to try to limit slippage and to thus provide consistent tensioning and feeding of the yarns through the system. As a result, the spacing and intermeshing of the rolls is critical for achieving a uniform, substantially constant flow of the yarns through the rolls without significant slippage or misfeeding of the yarns. As a consequence, it generally has been necessary to monitor and make frequent adjustments to the positions and spacings between the rolls to compensate for the feeding of different sizes or thicknesses of yarns. Such adjustments typically are made manually through the use of adjustment shims, which manual adjustments often are not sufficiently precise, and thus can necessitate additional adjustments. Furthermore, the pinching of the yarns by the rolls can damage or cause breaking of the yarns if the spacing or pinching is too tight or can cause jamming of the rolls if knots are passed therebetween, resulting in misfeeding of the yarns.

There is, therefore, a need for an improved puller roll system that can securely and consistently tension yarns of various sizes to the needles of a tufting machine without requiring continuous adjustment of the puller rolls.

SUMMARY OF THE INVENTION

Briefly described, the present invention relates to an improved puller roll system for feeding yarns to the needles of a tufting machine. According to one embodiment of the invention, the puller roll system includes at least one driven puller roll and a pair of floating puller rolls. The driven and floating puller rolls each include radially projecting teeth, and the floating puller rolls are mounted in an intermeshing relationship with the driven puller roll so that the floating puller rolls are rotated with the rotation of the driven puller roll. A yarn engagement path is defined between the driven puller roll and the floating puller rolls along which the yams are received and are passed in a winding, substantially serpentine path. The puller rolls engage the yarns along the engagement path at multiple points or areas of contact with the yarns being engaged between both of the floating puller rolls and the driven puller roll and with the yams being wrapped about a portion or wrap area of the driven puller roll.

As a result, the amount and/or area of contact between the yarns and the puller rolls is substantially increased so that the yarns can be securely tensioned through the engagement path towards the needles without requiring the yarns to be pinched tightly between the puller rolls. In addition, due to the increased areas and amount of contact along which the puller rolls engage the yams, the puller roll system of the present invention can be used to tension various types and sizes of yarns without requiring frequent adjustments of the positions of or spacings between the puller rolls. Consequently, the puller roll system of the present invention enables looser spacing between the puller rolls, with the spacings being set at a distance sufficient to enable a minimum engagement and contact between the yarns and the teeth of the puller rolls sufficient to tension the yarns without the yarns necessarily being tightly pinched between the rolls, which reduces the likelihood that the yarns will be damaged by the puller rolls.

Various object features and advantages of the present invention will become apparent to those of skill in the art upon reading the following detailed description in view of the accompanying drawings.

DETAILED DESCRIPTION OF THE INVENTION

Figure 1:
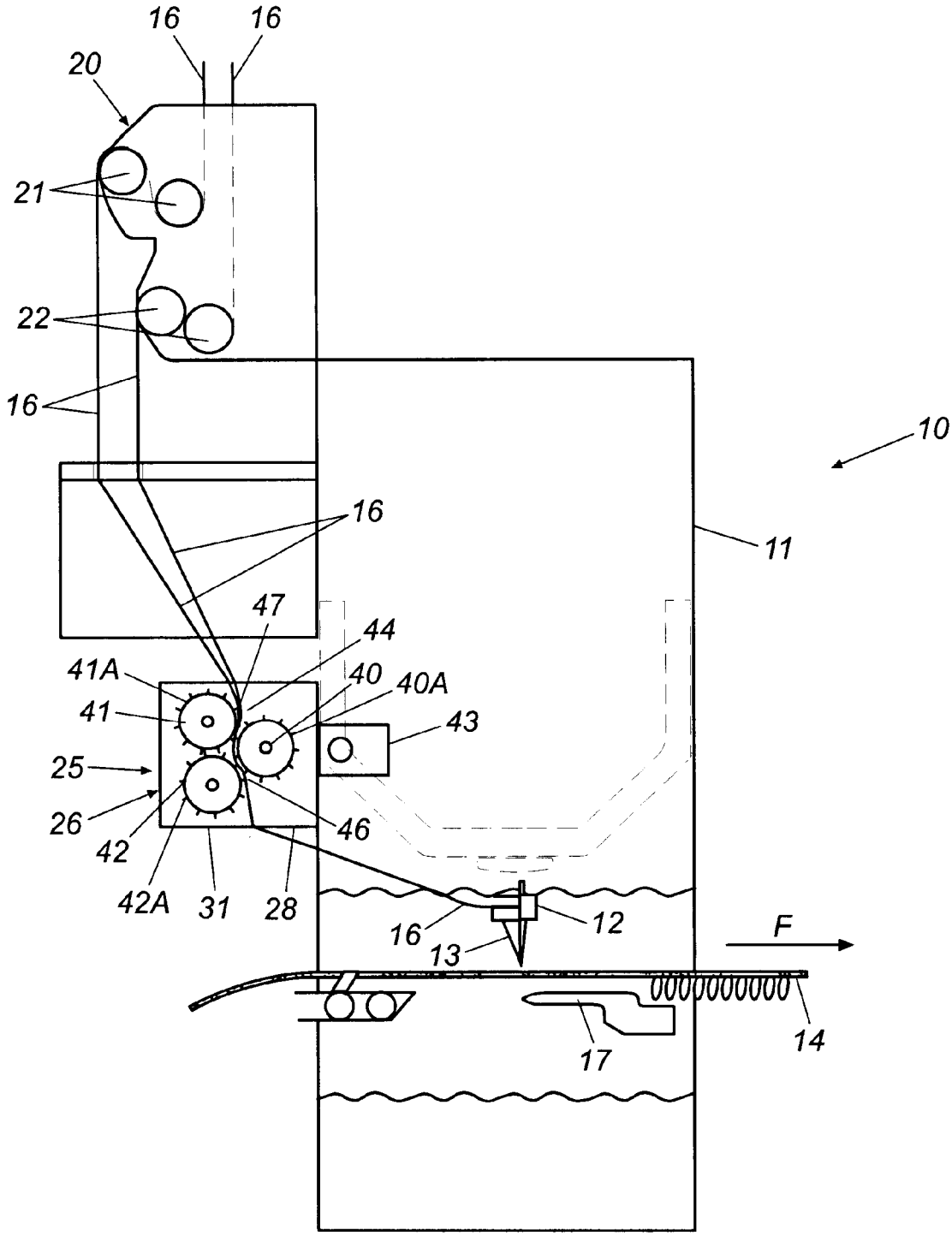
FIG. 1 is a side view schematically illustrating a tufting machine including a puller roll system according to one embodiment of the present invention.

Referring now to the drawings in which like numerals indicate like parts throughout the several views, FIG. 1 discloses a tufting machine 10 including a frame 11 and a reciprocable needle bar 12 supporting a plurality of spaced needles 13 disposed therealong. The needles 13 are reciprocated vertically through a backing fabric or material 14, as the backing fabric 14 is moved through the machine 10 in a direction of feed indicated by arrow F. Each of the needles carries a yarn 16 and cooperates with a corresponding looper 17 so as to form a series of loops or tufts of yarn in the backing fabric 14 as each needle penetrates the backing fabric, as indicated in FIG. 1. The tufting machine 10 further includes a yarn feed mechanism 20 that is mounted on and supported by the tufting machine frame and includes a series of yarn feed rolls 21, 22 that feed the yarns 16 at prescribed or programmed rates of feed in accordance with programmed pattern instructions to the puller roll assembly 25 of the present invention for the feeding of the yarns 16 to the individual needles 13 to form or tuft desired patterns in the backing fabric passing beneath the needles 13.

It will be understood that the yarn feed mechanism 20 can include any type of known pattern yarn feed mechanisms, including computer controlled, motor driven yarn feed rolls or other conventional yarn feed/drive mechanisms including roll and scroll type pattern attachments that control the feeding of all the yarns across the width of the tufting machine to their respective needles. Other known types of yarn feed mechanisms that can be used include multiple feed rolls for controlling the feeding of specific sets or repeats of yarns to selected needles, and further including the use of individual yarn feed rolls for controlling the feeding of individual yarns to a respective needle. For example, U.S. Pat. Nos. 6,009,818 and 5,983,815 disclose pattern yarn feed devices for controlling the feeding and distribution of the yams, and U.S. Pat. No. 5,979,344 discloses a precision drive system for driving various operative elements of the tufting machine, which systems can be used with the present invention and are incorporated herein by reference.

As shown in FIG. 1, the puller roll assembly 25 of the present invention is mounted to the tufting machine frame 11 between the yarn feed mechanism and the needles and receives and pulls the yarns 16 from the yarn feed mechanism 20 and feeds the yarns 16 to needles 13. The puller roll assembly 25 (FIG. 2) generally includes a pair of spaced bearings or mounting brackets 26 and 27 that are mounted to the tufting machine frame as conventionally known. The mounting brackets or bearings generally are substantially "U" or "C" shaped brackets or plates, typically formed from a metal or other similar material. Each mounting bracket or bearing generally includes a forward or proximal bearing member or portion 28 that is mounted to the tufting machine frame by a series of spaced machine mounts 29(FIGS. 3 and 4), such as bolts, screws or other similar kinds of fasteners, and a rearward, distal bearing member or portion 31 that generally is adjustably mounted with respect to its forward bearing member 28, in a position spaced from the forward, proximal bearing member or portion.

Figure 3:
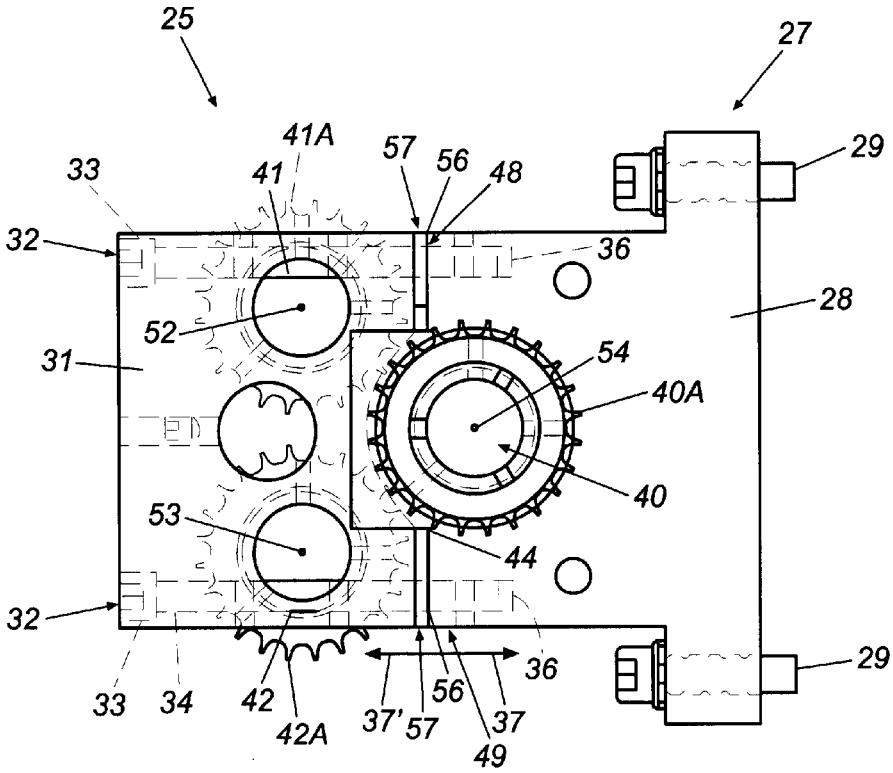
FIG. 3 is an end view, with portions removed, of the puller roll system of FIG. 1.

As indicated in FIG. 3, the distal bearing member 31 of each bearing or mounting bracket is adjustably mounted to its proximal bearing member 28 by fasteners, shown in dashed lines 32, such as bolts, screws, pins or other similar kinds of fasteners or adjustable mounting mechanisms. The fasteners 32 generally each include a head 33 that typically is countersunk into the distal bearing members 31 and a shank portion that extends through its distal bearing member 31 and is received in and engages a corresponding recess or aperture 36 formed in the proximal bearing member 28 therefor.

Figure 2:
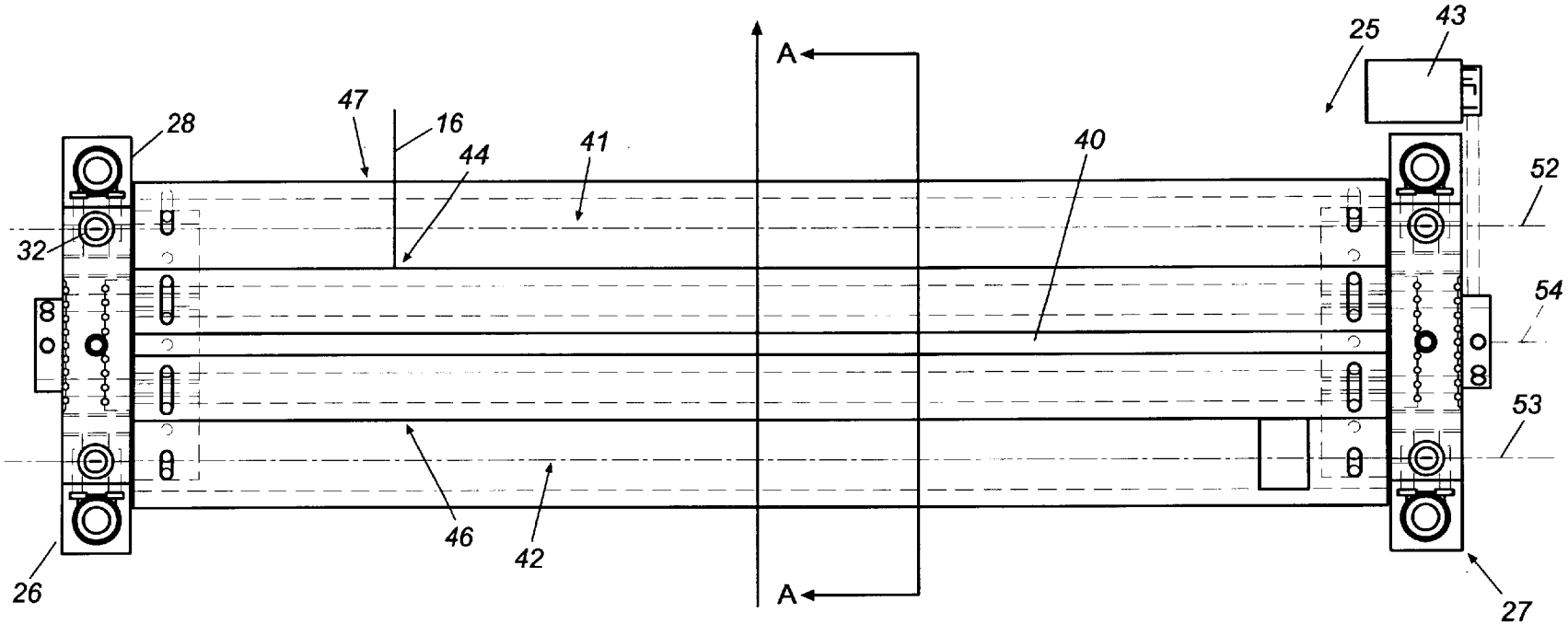
FIG. 2 shows a cut-away, back side view of the puller roll system of the present invention.
Figure 4:
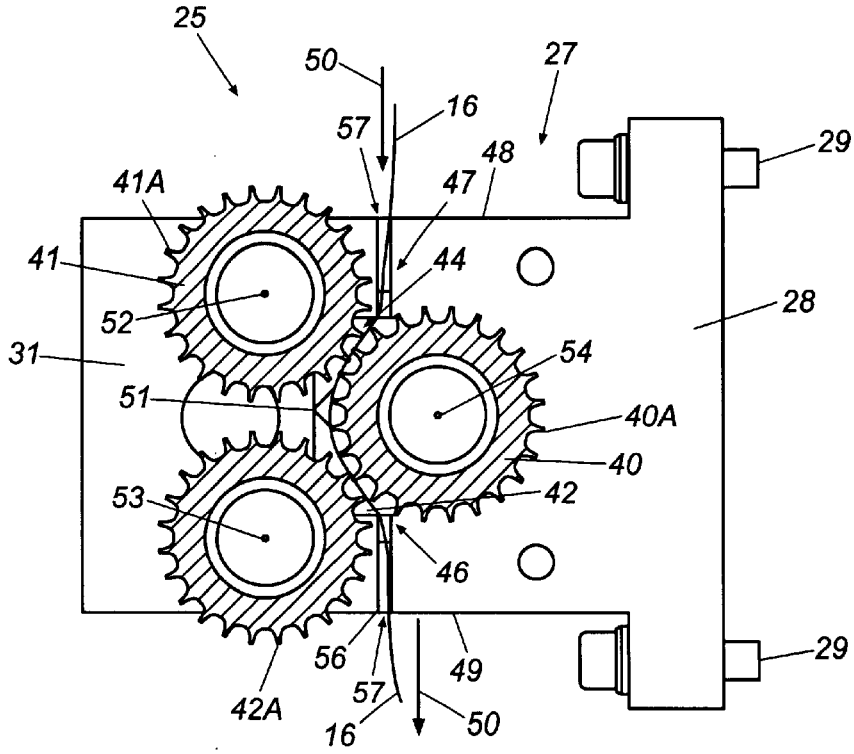
FIG. 4 shows a cross-sectional view of the puller roll system of the present invention taken along section A—A of FIG. 2.

As indicated in FIGS. 2–4, the mounting brackets 26 and 27 rotatably support a series of intermeshing puller rolls 40, 41, and 42 at each end thereof. Each of the puller rolls 40–42 generally is an elongated roll or gear having a series of radialy projecting teeth 40A, 41A, and 42A, respectively, which teeth intermesh and engage the yarns 16 (FIG. 4) therebetween as the rolls are rotated. A first one of the puller rolls 40 generally is mounted to the proximal bearing members 28 of the mounting brackets 26 and 27 and is a power driven puller roll, generally driven by a motor, such as indicated by 43 in FIG. 1, in a known or conventional manner. The remaining or second and third puller rolls 41 and 42 (FIGS. 3 and 4) generally are idler or floating puller rolls, each rotatably mounted at their ends to the distal bearing members 31 of mounting brackets 26 and 27 (FIG. 2). The floating puller rolls 41 and 42 generally are rotated with the rotation of the drive roll 40, as the teeth 41A and 42A of puller rolls 41 and 42 are engaged and intermesh with the teeth 40A of the driven puller roll 40. This engagement between the teeth of the floating puller roll and the driven puller roll creates or defines multiple areas of contact 44 and 46 between the teeth of puller rolls 40 and 41, and between puller rolls 40 and 42, respectively.

As illustrated in FIGS. 3 and 4, a yarn engagement path 47 is defined between the rolls and extends from an upper end or entrance 48 of the puller roll assembly 25 to a lower end or exit 49 from which the yarns 16 are passed for feeding to their respective needles in the direction of arrows 50 (FIG. 4). As the yarns are passed along the yarn path 47, they are engaged between the teeth 40A and 41A of puller rolls 40 and 41 at a first area of contact 44, and are further engaged between the intermeshing teeth 40A and 42A of puller rolls 40 and 42 at a second area of contact 46 to provide multiple points of engagement and gripping between the teeth of the puller rolls and the yams. In addition, between the areas of contact 44 and 46, the yarns 16 wrap at least partially around the driven puller roll 40 along a wrap area or region 51 defined along a portion of the circumference or periphery of the driven puller roll 40, between the areas of contact 44 and 46, providing still further engagement of the yarns with the driven puller roll. This increased or enhanced engagement of the yarns at multiple points or areas of contact between the teeth of the driven and floating puller rolls 40 and 41 and 42, respectively, as well as the further engagement of the yarns by the teeth 40A of driven puller roll 40 at the wrap area 51 along the driven puller roll 40 provides an enhanced positive gripping of the yarns and minimizes risk of slippage of the yarns as it is pulled through or along its yarn engagement path 47 between the puller rolls 40, 41, and 42.

The floating puller rolls generally are positioned in substantially parallel and vertically spaced, aligned positions, each oriented at an angle with respect to the driven puller roll such that the central axis 52 and 53 of each floating puller roll is laterally offset from the central axis 54 of the driven puller roll 40 as shown in FIGS. 3 and 4. As a result, the multiple areas of contact 44 and 46 are provided at spaced locations with the wrap area 51 defined therebetween, and with the yarn path generally extending along a curved path about the drive roll so that the yarns are moved along a somewhat serpentine path through the puller rolls. The positions of the floating puller rolls 41 and 42 with respect to the driven puller roll 40 generally are adjustable by the adjustment or movement of the distal bearing members 31 with respect to their associated proximal bearing members 28 of the mounting brackets 26 and 27 in order to adjust or set the spacing and thus the amount of engagement between the teeth of the puller rolls as needed for feeding a desired range of thicknesses or sizes of yams. Additionally as indicated in FIGS. 3 and 4, shims 56 can further be placed within the gaps 57 between the proximal and distal bearing members 28 and 31 as desired to help secure or fix the spacing of the proximal or distal bearing members and thus the spacing of the driven and floating 40 and 41 and 40 and 42 puller rolls with respect to one another.

With the present invention, the floating puller rolls 41 and 42 do not have to be mounted in a tight, pinching engagement with the drive roll 40 so that the yarns 16 (FIG. 4) are tightly engaged and pinched between the teeth of the floating and drive puller rolls avoid slippage and to ensure positive engagement of the yarns by the puller roll assembly of the present invention. Instead, with the puller roll assembly of the present invention, by providing multiple points or areas of contact and an additional at least partial wrapping of the yarns about the periphery of the driven puller roll 40, the spacings between the puller rolls can be much looser, typically being set at a minimum engagement or spacing so as to enable relatively loose or light contact or engagement of the yarns therebetween with the potential for slippage of the yarns minimized, instead of requiring a very tight, pinching engagement of the yarns between the teeth of the puller rolls as generally is necessary in conventional puller roll assemblies.

As a result, with the puller roll assembly of the present invention, the floating and drive puller rolls are spaced sufficiently to maintain a minimum amount of contact between the yams and the intermeshing teeth of the puller rolls, which spacing is sufficient to provide a positive engagement and pulling of the yarns with the risks of slipping being minimized, but without the yarns further having to be tightly engaged and pinched between the puller roll teeth. In addition, by providing multiple areas or zones of contact 44 and 46, and a wrap area 51 along which the yarns are engaged by the teeth of the drive roll 40, the floating puller rolls of the present invention generally do not need to be continually adjusted with respect to the drive roll 40, and, can accommodate the feeding of a variety or range of different size thickness yarns and the passage of knots or other imperfections or obstructions in the yarns passing therethrough without the yarns becoming jammed and/or requiring frequent, precise mechanical adjustment of the positions of the floating puller rolls with respect to the driven puller roll 40.

In the operation of the puller roll assembly 25 of the present invention, a series of yarns 16 (FIG. 1) are fed from the yarn feed mechanism 20 into the upper end 48 (FIG. 4) of the puller roll assembly 25. The yarns 16 are passed along a yarn path 47 between driven puller roll 40 and floating puller rolls 41 and 42. The yarns are engaged between the intermeshing teeth 40A and 41A of the driven and floating puller rolls 40 and 41, respectively, at a first area of contact 44, then are extended or wrapped about a wrap zone or area 51 extending at least partially about the periphery of drive roll 50, and further are engaged along a second area of contact 46 between the teeth 40A and 42A of driven puller roll 40 and floating puller roll 42, respectively. The intermeshing teeth of the drive and floating puller rolls at the areas or points of contact 44 and 46 tend to lightly engage and pull the yarns at multiple points of contact. In addition, the friction between the yarns and teeth 40A of driven puller roll 40 along the wrap area 51, in conjunction with the engagement of the yarns at the areas of contact 44 and 46, helps the yarns to be pulled along the yarn path 47 through the puller roll assembly 25 without requiring a tight pinching engagement of the yarns by the teeth of the puller rolls. The yarns exit the puller roll assembly at the lower end 49 thereof, and are fed to individual needles 13 (FIG. 1) at a prescribed rate of feed for insertion into the backing fabric 14 passing through the tufting machine.

The present invention thus provides a cost effective and reliable puller roll assembly for feeding the yarns to the needles of a tufting machine, which does not require a tight, pinching contact between the teeth of the rolls and yarns to avoid potential slippage of the yarns, and further permits or accommodates the feeding of various size or thickness of yarns without requiring continual or frequent adjustments of the spacing of the puller rolls for effectively and consistently feeding the yarns to the respective needles. It will be understood by those skilled in the art that while the foregoing invention has been disclosed with reference to preferred embodiments or features, various modifications, changes and additions can be made to the foregoing invention without departing from the spirit and scope of the invention as set forth in the following claims.

What is claimed is:

1. A puller roller system for tensioning the yarns between yarn feed rollers and the needles of the tufting machine, comprising:

at least one elongated power driven puller roll rotatably mounted having a series of radially projecting teeth; and a series of elongated floating puller rolls rotatably mounted adjacent to said driven puller roll, said floating puller rolls each having a series of radially projecting teeth, wherein said driven puller roll is disposed in an intermeshing, driving relationship with said floating puller rolls with a minimum spacing defined therebetween sufficient to enable said projecting teeth of said driven puller roll to mesh with said projecting teeth of said floating puller rolls to cause said floating puller rolls to rotate and to positively engage the yarns at multiple areas of contact as the yarns move along a yarn engagement path therebetween so as to place tension on the yarns passing therebetween without pinching the yarns and with slippage of the yarns from between the puller rolls minimized.

2. The puller roller system of claim 1, wherein the yarns are extended around and engaged at a wrap portion defined along said driven puller roll between said multiple areas of contact.

3. The puller roller system of claim 1 and further comprising a pair of spaced mounting brackets.

4. The puller roller system of claim 3 and wherein said mounting brackets each include a proximal bearing member and a distal bearing member laterally adjustable with respect to said proximal bearing member.

5. The puller roller system of claim 4 wherein said driven puller roll is mounted on said proximal bearing members and said floating puller rolls are mounted on said distal bearing member so as to be moved toward and away from said driven puller roll for adjusting the spacings between said driven and floating puller rolls with the movement of said distal bearing members with respect to said proximal bearing members.

6. A puller roller system for tensioning the yarns between yarn feed rollers and the needles of the tufting machine, comprising:

at least one rotatably mounted elongated power driven puller roll having a series of radially projecting teeth;

a series of floating puller rolls mounted in a vertically spaced relationship to one another, with said driven puller roll disposed partially between said floating puller rolls, said floating puller rolls each having a series of radially projecting teeth;

wherein said driven puller roll is disposed in an intermeshing, driving relationship with said floating puller rolls with a minimum spacing defined therebetween sufficient to enable said projecting teeth of said driven puller roll to mesh with said projecting teeth of said floating puller rolls to cause said floating puller rolls to rotate and to positively engage and tension the yarns at multiple areas of contact.

7. The puller roller system of claim 6, wherein said driven puller roll includes a central axis that is laterally offset from a central axis of each said floating puller rolls.

8. In a tufting machine of the type having a machine frame, and at least one reciprocable needle bar having a series of spaced needles mounted therealong, each carrying a yarn for forming tufts of yarns in a backing material passing therebeneath, the improvement therein comprising:

a puller roll assembly mounted to the machine frame for tensioning the yarns being fed to the needles, said puller roll assembly comprising:

a driven puller roll having a series of radially projecting teeth; and a pair of floating puller rolls mounted at spaced positions, each laterally offset from said driven puller roll and with each of said floating puller rolls having a series of radially projecting teeth adapted to engage and mesh with said teeth of said driven puller roll to cause rotation of said floating puller rolls;

wherein a yarn engagement path is defined between said driven and floating puller rolls along which the yarns are engaged at multiple points of contact, and wherein said floating puller rolls are positioned at a minimum spacing from said driven puller roll sufficient to enable positive engagement and tensioning of the yarns at said multiple points of contact without requiring tight pinching contact of the yarns between said teeth of said puller rolls.

9. The tufting machine of claim 8, wherein said floating puller rolls are mounted in a vertically spaced relationship to one another and said driven puller roll is disposed partially between said floating puller rolls.

10. The tufting machine of claim 9, wherein said yarn is extended around and engaged by said teeth of said driven puller roll along a wrap portion of said driven puller roll.

11. The tufting machine of claim 8 and wherein said puller roll assembly further comprises a pair of spaced mounting brackets.

12. The tufting machine of claim 11 and wherein said mounting brackets each include a proximal bearing member and a distal bearing member laterally adjustable with respect to said proximal bearing member.

13. The tufting machine of claim 12 and wherein said driven puller roll is mounted on said proximal bearing members and said floating puller rolls are mounted on said distal bearing member so as to be moved toward and away from said driven puller roll for adjusting the spacing between said driven and floating puller rolls with the movement of said distal bearing members with respect to said proximal bearing members.

* * * * *

UNITED STATES PATENT AND TRADEMARK OFFICE

CERTIFICATE OF CORRECTION

PATENT NO. : 6,725,789 B1
DATED : April 27, 2004
INVENTOR(S) : Hall

It is certified that error appears in the above-identified patent and that said Letters Patent is hereby corrected as shown below:

Column 2,
Line 14, delete “yams” and insert -- yarns --;

Column 3,
Line 13, delete “yams” and insert -- yarns --;

Column 4,
Line 14 and 47, delete “yams” and insert -- yarns --;

Column 5,
Line 8, delete “yams” and insert -- yarns --.

Signed and Sealed this

Third Day of August, 2004

JON W. DUDAS
*Acting Director of the United States Patent and Trademark Office*